United States Patent [19]

Kells

[11] 4,148,194

[45] Apr. 10, 1979

[54] REFRIGERATOR TEMPERATURE CONTROLS

[76] Inventor: John D. Kells, 1678 71st St., Brooklyn, N.Y. 11204

[21] Appl. No.: 833,813

[22] Filed: Sep. 15, 1977

[51] Int. Cl.[2] ..... F25B 21/02; F25D 29/00; F25D 11/02

[52] U.S. Cl. ..... 62/3; 62/161; 62/441

[58] Field of Search ..... 62/3, 441, 442, 228, 62/131, 161

[56] References Cited

U.S. PATENT DOCUMENTS

| | | | |
|---|---|---|---|
| 2,133,818 | 10/1938 | Hulse | 62/161 |
| 2,964,912 | 12/1960 | Roeder, Jr. | 62/3 |
| 2,986,009 | 5/1961 | Gaysowski | 62/441 |
| 3,073,127 | 1/1963 | Schmerzler | 62/3 |
| 3,220,198 | 11/1965 | Muller et al. | 62/3 |
| 4,014,178 | 3/1977 | Kells | 62/3 |

FOREIGN PATENT DOCUMENTS

| | | | |
|---|---|---|---|
| 1113461 | 9/1961 | Fed. Rep. of Germany | 62/442 |

*Primary Examiner*—Lloyd L. King
*Attorney, Agent, or Firm*—Clarence A. O'Brien; Harvey B. Jacobson

[57] ABSTRACT

A double door combination refrigerator freezer is provided and includes electrical refrigerating apparatus for maintaining the food and freezer compartment thereof cool. The food and freezer compartment doors each include a temperature indicating structure for indicating the internal temperature of the corresponding compartment as well as an adjustable electo-thermocouple for controlling the operation of the electrical refrigerating apparatus in a manner to vary the temperature in the corresponding compartment. The electro-thermocouples are electrically connected to the controlling circuitry for the electrical refrigerating apparatus by means of corresponding door and cabinet circuitry connected in series by means of corresponding coacting door and cabinet door jamb compression switch structure.

1 Claim, 4 Drawing Figures

REFRIGERATOR TEMPERATURE CONTROLS

BACKGROUND OF THE INVENTION

1. Field of the Invention

Various forms of controls for varying the temperatures in food and freezer compartments of combination refrigerator-freezers have been heretofore provided.

One such special form is depicted in the U.S. patent cited below. However, in that instance the storage volumes in both the freezer compartment and in the refrigerator food compartment are seriously impaired by reason of the requirement of embodying internal chambers of substantial dimensions in both aforementioned compartments. This would result in the production of a refrigerator, space wasteful exteriorally and restrictive of food storage volume interiorally.

Indeed, refrigerator units such as depicted in the cited patent do provide a measure of convenience for refrigerator temperature controls, although the temperature registering thermometers on the one hand and the manually operated temperature adjusting knobs on the other, are rather widely separated and that situation would benefit from a closer relationship between the two functions.

Accordingly, there exists good room for improvement over the cited patent in the form of a combination refrigerator-freezer incorporating temperature monitoring and control external to same, and at the same time eliminating the disadvantages stated above.

2. Description of the Prior Art

A typical form of combination refrigerator-freezer including external controls is illustrated in my prior U.S. Pat. No. 4,014,178, issued Mar. 29, 1977.

BRIEF DESCRIPTION OF THE INVENTION

The combination refrigerator-freezer of the instant invention includes door mounted thermometers and adjustable temperature controls whereby the internal temperatures of the freezer and food compartments may be monitored and adjusted from the exterior of the combined refrigerator-freezer without opening either door thereof. In that connection, however, it should be noted that in contrast to my prior U.S. Pat. No. 4,014,178, the instant invention provides a unique disposition and design of the refrigerator temperature control system with distinct and important improvements over the temperature control system covered by my above prior U.S. Pat. No. 4,014,178 all as shown and described in the drawing and specifications herewith.

In addition, the door mounted thermometers and adjustable temperature controls are mounted from the food and freezer compartment doors in a manner such that internal volume of the refrigerator and freezer compartments is not sacrificed. Further, the adjustable thermocouple controls mounted on the doors of the combined refrigerator-freezer are electrically connected to the cabinet mounted electrical refrigerating apparatus through compression switch components carried by the doors and the door frames. In this manner, the controlling electrical circuits to the electrical refrigerating apparatus mounted within the cabinet are opened when the corresponding doors of the combination refrigerator-freezer are opened, thereby avoiding the wasting of operating energy while the doors are in open position.

The main object of this invention is to provide independently operable electrical refrigerating apparatus controls on the food compartment and freezer compartment doors of a combined refrigerator-freezer whereby the temperature within the freezer and food compartments may be readily controlled from the exterior of the combined refrigerator-freezer without opening either door thereof.

Another object of this invention is to provide a combined refrigerator-freezer of the two-door type wherein each door includes a thermometer for indicating the internal temperature of the corresponding interior compartment of the combined refrigerator-freezer.

Another very important object of this invention is to provide an efficient means for electrically connecting the adjustable door mounted controls with the electrical refrigerating apparatus mounted in the cabinet of the combined refrigerator-freezer.

A final object of this invention to be specifically enumerated herein is to provide a combined refrigerator-freezer with exteriorly independently adjustable controls for the food and freezer compartment thereof which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
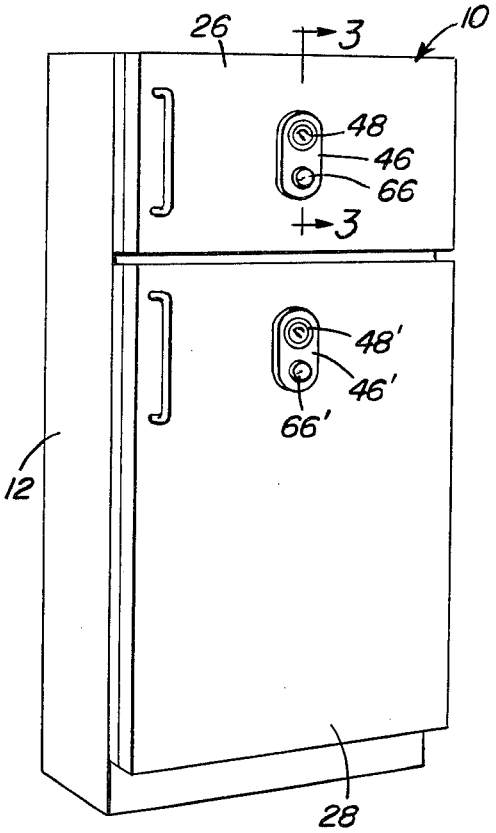
FIG. 1 is a perspective view of a combined refrigerator-freezer constructed in accordance with the present invention.

Referring now more specifically to the drawings, the numeral 10 generally designates a combined refrigerator-freezer unit constructed in accordance with the present invention. The unit 10 includes a cabinet referred to in general by reference numeral 12 defining an upper freezer compartment 14 and a lower food compartment 16. The cabinet 12 includes a jamb 18 defining a forward opening 20 for the freezer compartment 14 and a jamb 22 defining a forward opening 24 for the food compartment 16.

Figure 2:
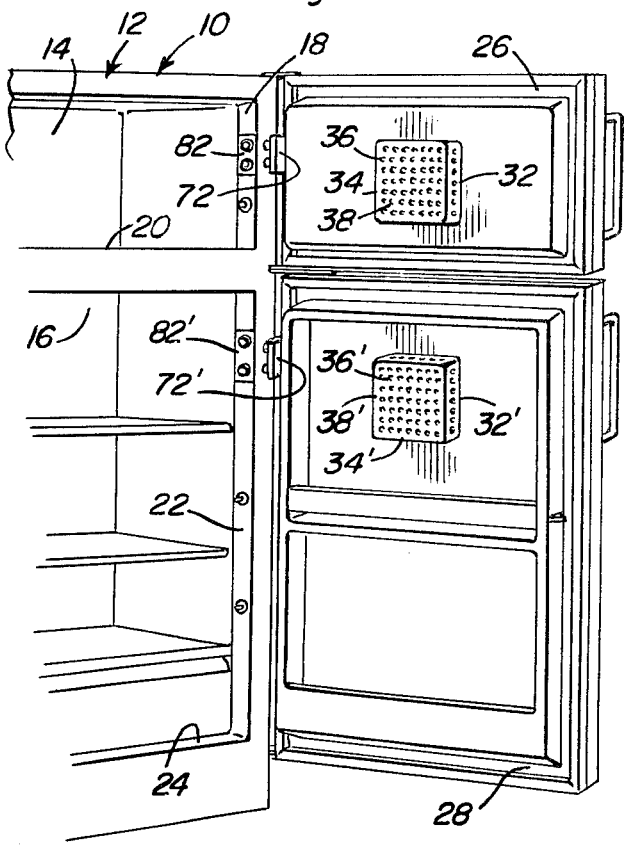
FIG. 2 is a fragmentary, perspective view of the combined refrigerator-freezer with the food and freezer compartment doors thereof in open positions.
Figure 3:
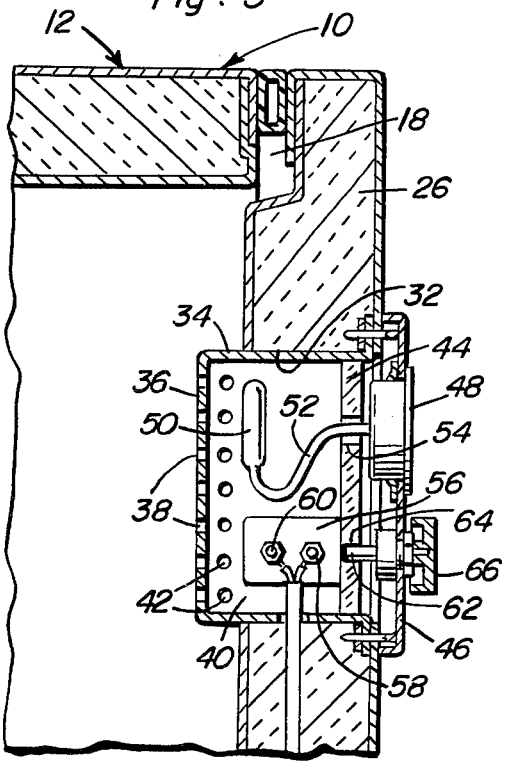
FIG. 3 is an enlarged, fragmentary, vertical, sectional view taken substantially upon the plane indicated by the section line 3—3 of FIG. 1.
Figure 4:
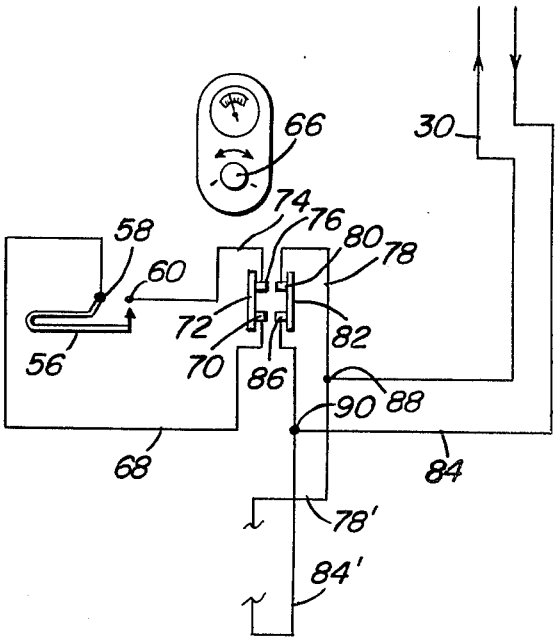
FIG. 4 is a schematic view of one of the door mounted control circuits and illustrating the manner in which the door mounted control circuit is electrically connected to the cabinet mounted electrical refrigerating apparatus circuit through the utilization of door and door frame mounted coacting compression switch structures.

An upper door 26 is hingedly supported from the jamb 18 and is swingable from the open position thereof illustrated in FIG. 2 to the closed position thereof illustrated in FIG. 1 closing the opening 20. A second door 28 is pivotally supported from the jamb 22 and may be swung from the open position thereof illustrated in FIG. 2 to the closed position thereof illustrated in FIG. 1 closing the opening 24.

The cabinet 12 includes any suitable form of electrical refrigerating apparatus (not shown) and electrical control circuitry 30 for controlling operation of the electrical refrigerating apparatus.

The door 26 includes an opening 32 formed therethrough and an outwardly opening control enclosing box or housing 34 is secured within the opening. The inner or rear wall 36 of the housing 34 includes a plurality of air circulation openings 38 formed therein and the opposite side walls 40 of the housing 34 each also include a plurality of air circulation openings 42 formed therein. The front end of the box or housing 34 is closed by an insulative panel 44 and a mounting plate 46 is secured over the outer or forward end of the opening 32 in outward spaced relation relative to the panel 44. The mounting plate 46 supports a dial-type thermometer 48 (for which a bulb-type thermometer may be substituted) therefrom forward of the insulation panel 44 and the thermometer 48 includes a temperature sensing bulb 50 disposed within the the housing 34 rearward of the insulative panel 44 and connected to the thermometer 48 by means of a tube 52 extending through an opening 54 formed in the panel 44. In addition, a thermocouple 56 is mounted within the housing 34 rearward or inward of the insulative panel 44 and includes a pair of insulatively supported contacts 58 and 60. The thermocouple 56 includes a rotatable control shaft 62 which projects through an opening 64 formed in the insulative panel 44 below the opening 54 and a control knob 66 is mounted on the forward or outer end of the shaft 62 for rotating the shaft 62 from the exterior of the door 26 forward of the mounting plate 46.

A first conductor 68 is connected to the terminal 58 and a first terminal 70 of a door mounted switch section 72 and a second conductor 74 connected to the terminal 60 and a second terminal 76 of the switch section 72. A third conductor 78 extends between the terminal 80 of switch section 82 and a source (not shown) of electrical potential and the third conductor 78 has a refrigeration equipment motor serially connected therein. A fourth conductor 84 extends from the second terminal 86 of switch section 82 and the aforementioned source, the sections 72 and 82 comprising door and cabinet mounted switch sections, respectively, whereby the thermocouple 56 may be operative to open and close the electrical circuitry for the motor 30 in response to decreases and increases in the temperature within the compartment 14, according to the temperature setting of the knob 66 and also in response to opening and closing of the door 26.

The door 28 includes components corresponding to the components 32–76 and the cabinet 12 includes components corresponding to the components 78–86 and referred to by corresponding prime reference numerals and the conductors 78' and 84' are connected in parallel to the conductors 78 and 84 as at 88 and 90. Accordingly, each of the thermocouples may be operative to control actuation of the motor of the refrigeration equipment. Therefore, the control knobs 66 and 66' may be adjusted to vary the temperature within the compartments 14 and 16 and the thermometers 48 and 48' are operative to indicate the temperatures within the compartments 14 and 16.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In a refrigerator having cool and freezer compartments and a door for each compartment having an improved design and arrangement of the elements of a temperature control unit for manually regulating, with improved modality, compartment temperature from outside the refrigerator, each such control unit comprising a consolidated instrument panel containing two elements in juxtaposition, one element comprising a temperature indicator for the visible monitoring of internal compartment temperature and the second element comprising a manually operable rotatable temperature selector including a pointer registrable over a fixed calibrated temperature scale, said temperature selector being operative of a thermoelectric mechanism to regulate internal compartment temperature at the discretion of the operator of the rotatable temperature selector, said temperature control units each being externally mounted on and integral with the corresponding compartment door, each rotatable temperature selector being manually rotatable from exteriorly of the associated compartment door and each thermoelectric mechanism being recessed inwardly of the inner side of the associated door and having a protective shield thereover, the recessing of the thermoelectric mechanisms within the inner sides of the associated compartment doors resulting in elimination of space consuming thermoelectric mechanism housing chambers within the cool and freezer compartments.

* * * * *